US009999328B2

(12) United States Patent
Vanderstegen-Drake et al.

(10) Patent No.: US 9,999,328 B2
(45) Date of Patent: Jun. 19, 2018

(54) AUTONOMOUS CLEANING APPLIANCE

(75) Inventors: Mark Stamford Vanderstegen-Drake, Malmesbury (GB); James Dyson, Malmesbury (GB); Andre David Brown, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 266 days.

(21) Appl. No.: 13/608,667

(22) Filed: Sep. 10, 2012

(65) Prior Publication Data

US 2013/0061417 A1 Mar. 14, 2013

(30) Foreign Application Priority Data

Sep. 9, 2011 (GB) ..... 1115607.2

(51) Int. Cl.

| | |
|---|---|
| ***A47L 5/00*** | (2006.01) |
| ***A47L 5/30*** | (2006.01) |
| ***A47L 9/10*** | (2006.01) |
| ***A47L 9/14*** | (2006.01) |

(52) U.S. Cl.

CPC ..... *A47L 5/30* (2013.01); *A47L 9/106* (2013.01); *A47L 9/1409* (2013.01); *A47L 2201/00* (2013.01)

(58) Field of Classification Search

CPC ..... A47L 5/30; A47L 9/106; A47L 9/1409; A47L 2201/00

USPC ..... 15/319

See application file for complete search history.

(56) References Cited

U.S. PATENT DOCUMENTS

| | | | | |
|---|---|---|---|---|
| 4,782,550 | A * | 11/1988 | Jacobs | 15/320 |
| 6,481,515 | B1 * | 11/2002 | Kirkpatrick et al. | 180/65.1 |
| 6,493,612 | B1 * | 12/2002 | Bisset et al. | 701/23 |
| 6,553,612 | B1 * | 4/2003 | Dyson et al. | 15/340.1 |
| 6,605,156 | B1 * | 8/2003 | Clark et al. | 134/6 |
| 6,748,297 | B2 * | 6/2004 | Song et al. | 700/259 |
| 6,818,036 | B1 * | 11/2004 | Seaman | 55/426 |
| 6,925,679 | B2 * | 8/2005 | Wallach et al. | 15/319 |
| 7,210,192 | B2 * | 5/2007 | Ito et al. | 15/327.7 |
| 7,318,248 | B1 * | 1/2008 | Yan | 15/319 |
| 7,412,748 | B2 * | 8/2008 | Lee et al. | 15/340.1 |

(Continued)

FOREIGN PATENT DOCUMENTS

| | | |
|---|---|---|
| EP | 0803224 | 10/1997 |
| EP | 1 842 597 | 1/2009 |

(Continued)

OTHER PUBLICATIONS

JP2003219990A—Aug. 2003—English Machine Translation.*

(Continued)

*Primary Examiner* — Marc Carlson

(74) *Attorney, Agent, or Firm* — Morrison & Foerster LLP

(57) ABSTRACT

An autonomous vacuum cleaner comprising a main body defining a first axis and housing a dirty air inlet, a clean air outlet, an airflow path between the dirty air inlet and the clean air outlet and a separating apparatus arranged in the air flow path between the dirty air inlet and the clean air outlet, the separating apparatus defining a second axis, wherein the separating apparatus is oriented so that the second axis is substantially parallel with the first axis of the main body and wherein a portion of the separating apparatus protrudes from a forward portion of the main body of the vacuum cleaner.

16 Claims, 12 Drawing Sheets

(56) References Cited

U.S. PATENT DOCUMENTS

| | | | | |
|---|---|---|---|---|
| 7,424,766 | B2 * | 9/2008 | Reindle et al. | 15/319 |
| 7,581,282 | B2 * | 9/2009 | Woo | 15/319 |
| 7,603,744 | B2 * | 10/2009 | Reindle | 15/319 |
| 7,686,861 | B2 * | 3/2010 | Oh | 55/429 |
| 7,765,635 | B2 * | 8/2010 | Park | 15/319 |
| 7,770,253 | B2 * | 8/2010 | Ha et al. | 15/319 |
| 8,136,200 | B2 * | 3/2012 | Splinter | 15/319 |
| 8,417,383 | B2 * | 4/2013 | Ozick et al. | 700/258 |
| 8,428,776 | B2 * | 4/2013 | Letsky | 700/245 |
| 2002/0174506 | A1 * | 11/2002 | Wallach et al. | 15/319 |
| 2004/0088081 | A1 * | 5/2004 | Song et al. | 700/259 |
| 2005/0217042 | A1 * | 10/2005 | Reindle | 15/41.1 |
| 2006/0005344 | A1 * | 1/2006 | Uehigashi | 15/319 |
| 2006/0185690 | A1 * | 8/2006 | Song et al. | 134/21 |
| 2008/0010957 | A1 * | 1/2008 | Yun et al. | 55/399 |
| 2008/0023035 | A1 * | 1/2008 | Ha et al. | 134/18 |
| 2008/0052867 | A1 * | 3/2008 | Park | 15/319 |
| 2010/0050366 | A1 * | 3/2010 | Splinter | 15/319 |
| 2013/0061416 | A1 * | 3/2013 | Dyson et al. | 15/319 |

FOREIGN PATENT DOCUMENTS

| | | | | | |
|---|---|---|---|---|---|
| EP | 2 050 380 | | | 4/2009 | |
| JP | 2002-533796 | | | 10/2002 | |
| JP | 2003-219990 | | | 8/2003 | |
| JP | 2003219990 | A | * | 8/2003 | A47L 9/00 |
| JP | 2006296697 | A | * | 11/2006 | |
| WO | WO-00/38025 | A1 | | 6/2000 | |
| WO | WO-2008/009886 | | | 1/2008 | |

OTHER PUBLICATIONS

Search Report dated Dec. 21, 2011, directed to counterpart GB Application No. 1115607.2; 1 page.

Search Report and written opinion dated Nov. 6, 2012 directed towards International Application No. PCT/GB2012/052060;11 pages.

* cited by examiner

AUTONOMOUS CLEANING APPLIANCE

REFERENCE TO RELATED APPLICATIONS

This application claims the priority of United Kingdom Application No. 1115607.2, filed Sep. 9, 2011, the entire contents of which are incorporated herein by reference.

FIELD OF THE INVENTION

This invention relates to an autonomous cleaning appliance, and more specifically an autonomous or 'robotic' vacuum cleaner.

BACKGROUND OF THE INVENTION

Mobile robots are becoming increasingly commonplace and are used in such diverse fields as space exploration, lawn mowing and floor cleaning. The last decade has seen particularly rapid advancement in the field of robotic floor cleaning devices, especially vacuum cleaners, the primary objective of which is to navigate an area of a home or office autonomously and unobtrusively whilst cleaning the floor.

A known self-guiding vacuum cleaner is exemplified in EP0803224, which vacuum cleaner includes a chassis supporting a housing with a cover and a front part which is movable with respect to the chassis and forms part of a collision detecting system. The cover is secured to the housing and the housing continues immediately behind the front part into an intermediate wall. The intermediate wall continues into a handle by means of which the vacuum cleaner is carriable by a user.

As is common with robotic vacuum cleaners, the chassis supports a cleaner head having a brush bar, a fan/motor unit, a dust container, rechargeable batteries, drive motors for driving the diametrically located wheels, and a further drive motor to drive the brush bar. In addition, the cleaner is provided with an electronic control system interfaced as necessary with the drive motors and sensing systems so as to guide and control movement of the vacuum cleaner over a floor. In order to collect the dust that it has removed from the floor surface the vacuum cleaner is provided with a bag-type dust container that is located in a chamber defined by the intermediate wall described above. As will be appreciated, the dust container is housed within the outer cover of the vacuum cleaner which makes it awkward for a user to access.

SUMMARY OF THE INVENTION

It is against this background that the invention has been made and, to this end, the invention resides in an autonomous vacuum cleaner comprising a cylindrical main body having a cylindrical axis and housing a dirty air inlet, a clean air outlet, an airflow path between the dirty air inlet and the clean air outlet and a separating apparatus arranged in the air flow path between the dirty air inlet and the clean air outlet. The separating apparatus comprises a cylindrical container having an axis, wherein the separating apparatus is oriented so that its axis is substantially parallel with the cylindrical axis of the main body and wherein a portion of the separating apparatus protrudes from a forward portion of the main body of the vacuum cleaner.

In the invention, therefore, the separating apparatus resides in an upright orientation since its axis is substantially parallel to the cylindrical axis of the main body of the cleaner and what's more, the separating apparatus sits at the front of the cleaner and is partially exposed. This allows a user to gain easy access to the separating apparatus in when it needs to be emptied, and its upright orientation is easy to grasp by a user. In addition, the location of the separating apparatus means that it presents a resilient bumper to obstacles that the vacuum cleaner may hit when travelling about a room. Since it is a relatively large component without any relatively delicate electronics, the separating apparatus therefore provides a degree of bump protection to the vacuum cleaner, and also provides a degree of protection to obstacles with which the vacuum cleaner may collide.

In order to provide the vacuum cleaner with a low profile and, moreover, a 'clean' upper surface, the main body may define a flat upper surface and the separating apparatus may also define a flat upper surface which is co-planar with the flat upper surface of the main body. As well as contributing to a low profile of the vacuum cleaner, this configuration is also beneficial in circumstances where navigation sensors may be mounted to the upper surface of the main body and so provides such sensors with a 360° field of view, such as would be useful with rotating laser range finders.

To enhance the ease of mounting the separating apparatus into the main body, the main body may include a part-cylindrical docking bay portion into which the separating apparatus is receivable, the docking bay portion being shaped to complement the outer profile of the separating apparatus. To this end, the docking bay portion may be defined partly by a body portion and partly by a cover portion which may define first and second arm portions that flank opposite sides of the separating apparatus. The body portion may also include a platform portion to support a lower end of the separating apparatus.

The body portion may also include an airflow generator for generating airflow along an airflow path from the dirty air inlet to the clean air outlet.

The body portion may be carried on a chassis, the chassis including traction means for supporting the main body on a surface, and a cleaner head that defines the dirty air inlet, wherein the body portion may be movable relative to the chassis in response to a collision with an obstacle, sensing means being provided to sense the relative movement and provide an appropriate signal to a drive control system of the vacuum cleaner.

In another arrangement, there is provided an autonomous surface treating appliance comprising a main body and a handle movable with respect to the main body between a stowed position and a deployed position in which it can be gripped by a user to lift the appliance from the floor. When in the stowed position, the handle engages a component of the appliance to prevent access thereto or removal thereof.

The handle therefore performs multiple functions, for example allowing a user to lift and carry the device whilst also serving as a retention device for another component of the machine and/or also as a movable access door. Although this is useful in various forms of surface treating appliances such as floor polishers and sweepers, it has particular use in the field of mobile robotic vacuum cleaners.

The main body of the appliance may be substantially circular in plan profile and, advantageously, the handle may be pivoted about first and second journals provided on diametrically opposite points on the main body.

In the deployed position, the handle may extend in a plane substantially perpendicular to a longitudinal axis of the appliance and, in this way, the appliance is free to adopt an orientation parallel to the floor surface when it is being carried by a user.

The further component of the appliance may be a removable panel of the appliance and the handle may be arranged such that, in the stowed position, it engages at least part of the removable panel so that it cannot be removed from the appliance by a user. In one embodiment, the removable panel includes a filter element positioned in an exhaust outlet of the appliance, the panel being removable so that the filter element can be cleaned periodically by the user. More specifically, in the stowed position, the handle may sit inside a channel defined by the periphery of the appliance, the channel being at least partly defined by the removable panel.

Alternatively, or in addition, the further component may be one or more electrical sockets, which may be defined in the channel, such that in the stowed position the handle obscures at least part of the or each socket to prevent access by a user.

Form another aspect, the invention resides in an autonomous surface treating appliance comprising a main body defining an outer peripheral surface, and a handle movable with respect to the main body between a stowed position and a deployed position in which it can be gripped by a user to lift the appliance from the floor, wherein in the stowed position the handle extends in a plane lying at an angle to a longitudinal axis of the appliance and, when in the stowed position, the handle lies against at least part of the outer peripheral surface of the appliance.

Advantageously, this arrangement provides an autonomous appliance with a carrying arrangement that is unobtrusive to the user in the normal operation of the appliance since when in a stowed position it conforms to the peripheral surface of the appliance and so maintains its circular outer profile, whilst at the same time being readily accessible by a user for carrying the appliance, thereby enhancing portability.

BRIEF DESCRIPTION OF THE DRAWINGS

In order that the invention may be more readily understood, reference will now be made, by way of example only, to the accompanying drawings in which.

DETAILED DESCRIPTION OF THE INVENTION

Figure 1:
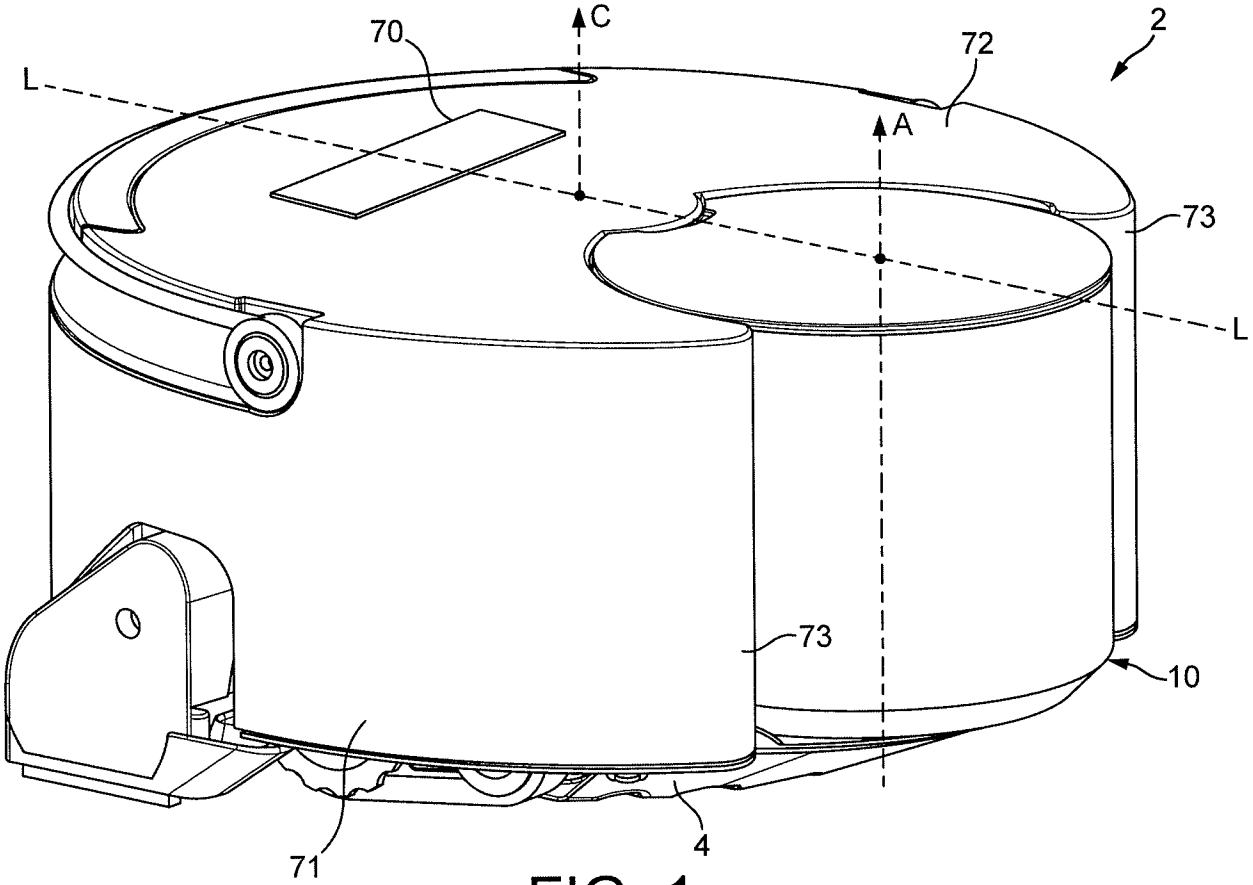
FIG. 1 is a front perspective view of an appliance in accordance with an embodiment of the invention.

With reference to FIGS. 1, 2, 3 and 4 of the drawings, an autonomous surface treating appliance in the form of a robotic vacuum cleaner 2 (hereinafter 'robot') has a main body comprising four principal assemblies: a chassis (or sole plate) 4, a body 6 which is carried on the chassis 4, a generally circular outer cover 8 which is mountable on the chassis 4 and provides the main body of the robot 2 with a profile of a generally circular cylinder, and a separating apparatus 10 that is carried on a forward part of the body 6 and which protrudes through a complementary shaped cutout 12 of the outer cover 8.

For the purposes of this specification, the terms 'front' and 'rear' in the context of the robot will be used in the sense of its forward and reverse directions during operation, with the separating apparatus 10 being positioned at the front of the robot. Similarly, the terms 'left' and 'right' will be used with reference to the direction of forward movement of the robot. As will be appreciated from FIG. 1, the main body of the robot 2 has the general form of a relatively short circular cylinder, largely for maneuverability reasons, and so has a cylindrical major axis 'C' that extends substantially vertically relative to the surface on which the robot travels. Accordingly, the cylindrical axis C extends substantially normal to a longitudinal axis of the robot 'L' that is oriented in the fore-aft direction of the robot 2 and so passes through the centre of the separating apparatus 10.

The diameter of the main body is preferably between 200 mm and 300 mm, and more preferably between 220 mm and 250 mm. Most preferably, the main body has a diameter of 230 mm which has been found to be a particularly effective compromise between maneuverability and cleaning efficiency.

The chassis 4 supports several components of the robot and is preferably manufactured from a high-strength injection moulded plastics material, such as ABS (Acrylonitrile Butadiene Styrene), although it could also be made from appropriate metals such as aluminium or steel, or composite materials such a carbon fibre composite. As will be explained, the primary function of the chassis 4 is as a drive platform and to carry cleaning apparatus for cleaning the surface over which the robot travels.

Figure 3:
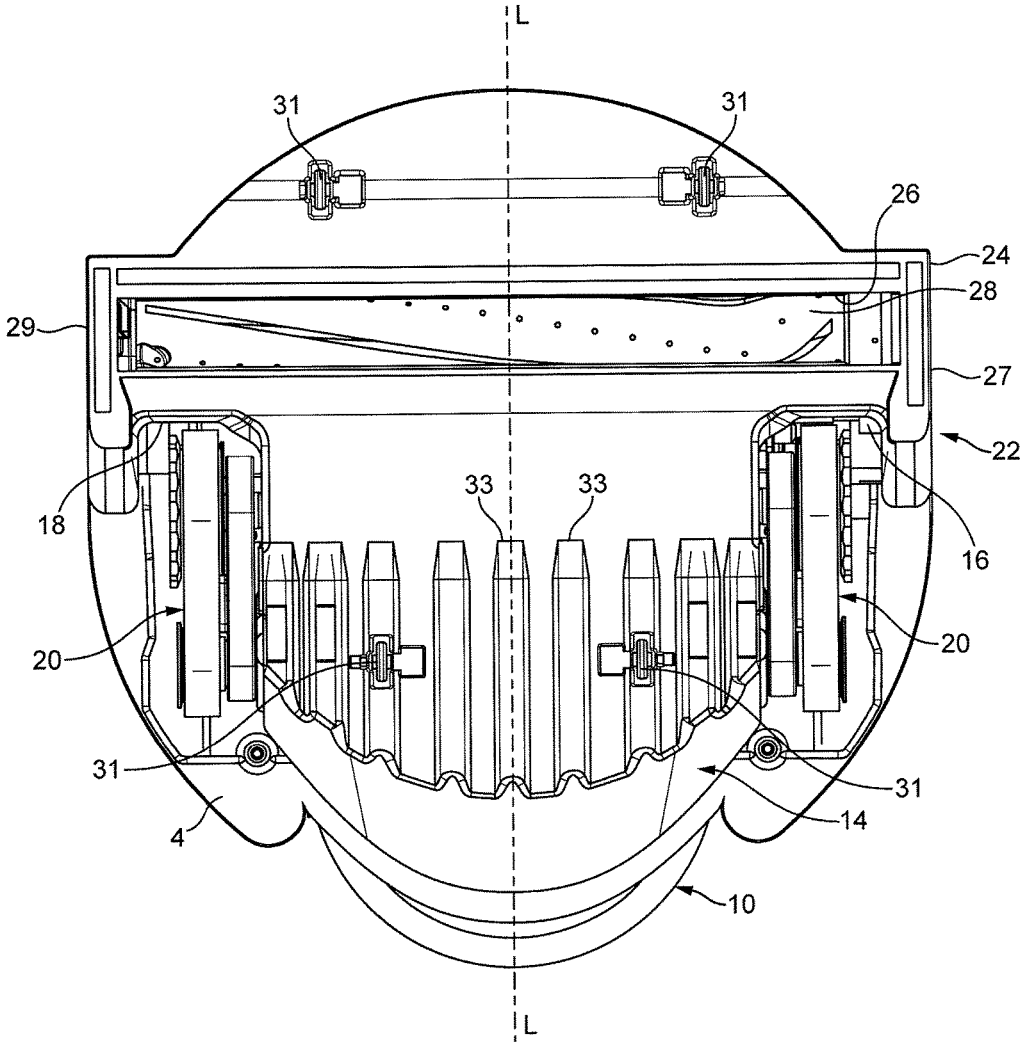
FIG. 3 is a view from beneath of the appliance in FIG. 1.
Figure 4:
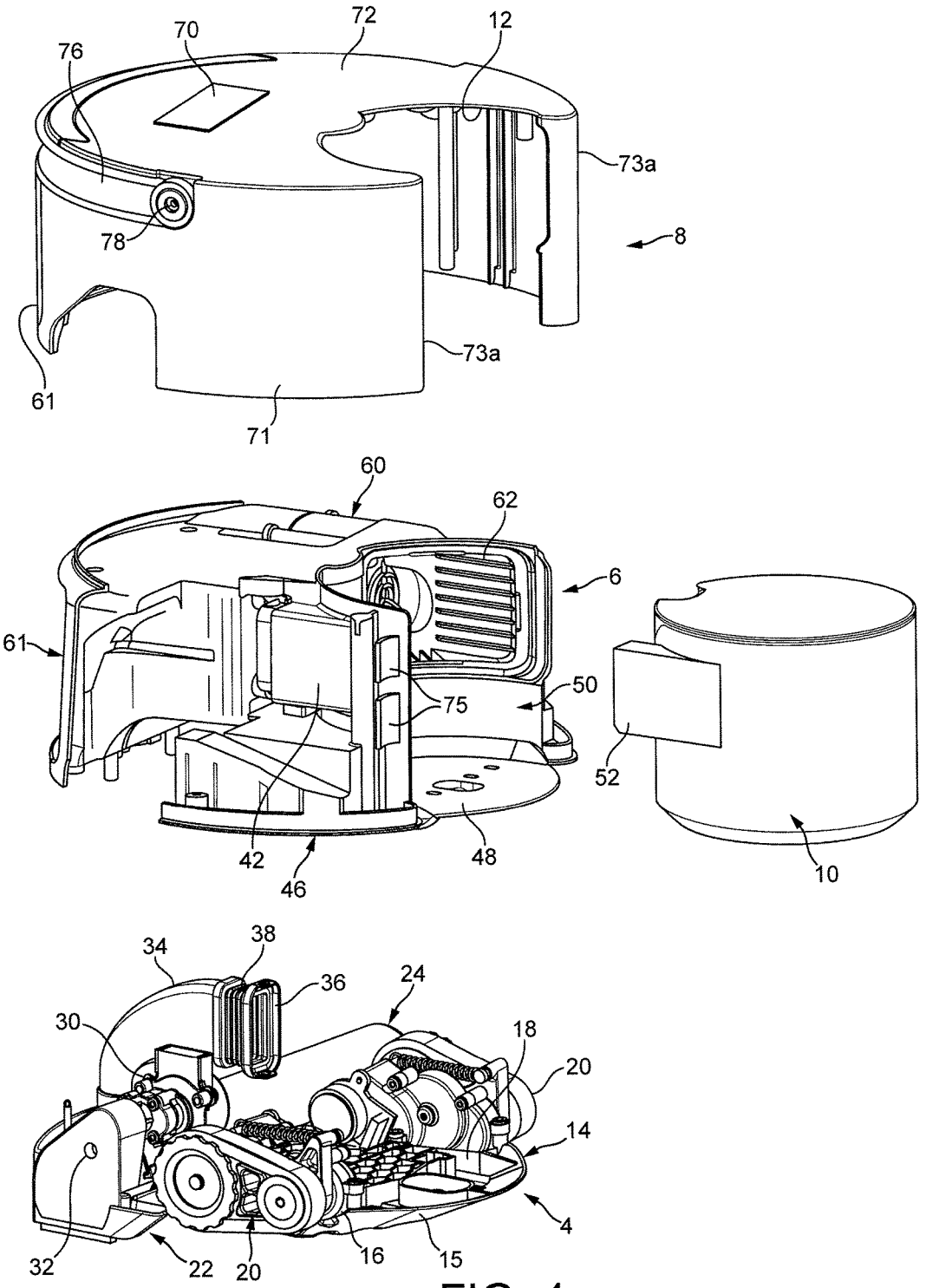
FIG. 4 is an exploded perspective view of the appliance of the invention showing its main assemblies.

With particular reference to FIGS. 3 and 4, a front portion 14 of the chassis 4 is relatively flat and tray-like in form and defines a curved prow 15 that forms the front of the robot 2. Each flank of the front portion 14 of the chassis has a recess 16, 18 in which recesses a respective traction unit 20 is mountable. It should be noted that in this embodiment, the traction units 20 are in the form of electrically driven caterpillar-track units having a continuous rubberized belt or track constrained around leading and trailing pulley wheels, although a simple wheel arrangement could also be used as an alternative.

The pair of traction units 20 are located on opposite sides of the chassis 4 and are operable independently to enable the robot to be driven in forward and reverse directions, to follow a curved path towards the left or right, or to turn on the spot in either direction, depending on the speed and direction of rotation of the traction units 20. Such an arrangement is sometimes known as a differential drive. The exact form of traction unit is not central to the invention and so will not be described in further detail.

The relatively narrow front portion 14 of the chassis 4 widens into a rear portion 22 which includes a cleaner head 24 having a generally cylindrical form and which extends transversely across substantially the entire width of the chassis 4 relative to its longitudinal axis L.

The cleaner head 24 defines a rectangular suction opening 26 that faces the supporting surface and into which dirt and debris is drawn into when the robot 2 is operating. An elongate brush bar 28 is contained within the cleaner head 24 and is driven by an electric motor 30 via a reduction gear and drive belt arrangement 32 in a conventional manner, although other drive configurations such as a solely geared transmission are suitable.

The underside of the chassis 4 forward of the suction opening 26 also includes a plurality of channels 33 (only two of which are labeled for brevity) which provide pathways for dirty air being drawn towards the suction opening 26. The underside of the chassis 4 also carries a plurality (four in the illustrated embodiment) of passive wheel or rollers 31 which provide further bearing points for the chassis 4 when it is at rest on or moving over a floor surface. It should be noted that the rollers 31 support the chassis such that the underside thereof is in a parallel orientation relative to a floor surface. Furthermore, although wheels or rollers are preferred, they could also be embodied as hard bearing points such as skids or runners.

In this embodiment, the cleaner head 24 and the chassis 4 are a single plastics moulding, thus the cleaner head 24 is integral with the chassis 4. However, this need not be the case and the two components could be separate, the cleaner head 24 being suitably affixed to the chassis 4 as by screws or an appropriate bonding technique as would be clear to the skilled person.

The cleaner head 24 has first and second end faces 27, 29 that extend to the edge of the chassis 4 and which are in line with the cover 8 of the robot. Considered in horizontal or plan profile as in FIGS. 2 and 3, it can be seen that the end faces 27, 29 of the cleaner head are flat and extend at a tangent (labeled as 'T') to the cover 8 at diametrically opposed points along the lateral axis 'X' of the robot 2. The benefit of this is that the cleaner head 24 is able to run extremely close to the walls of a room as the robot traverses in a 'wall following' mode therefore be able to clean right up to the wall. Moreover, since the end faces 27, 29 of the cleaner head 24 extend tangentially to both sides of the robot 2, it is able to clean right up to a wall whether the wall is on the right side or the left side of the robot 2. It should be noted, also, that the beneficial edge cleaning ability is enhanced by the traction units 20 being located inboard of the cover 8, and substantially at the lateral axis 'X', meaning that the robot can maneuver in such a way that the cover 8 and therefore also the end faces 27, 29 of the cleaner head 24 are almost in contact with the wall during a wall following operation.

Dirt drawn into the suction opening 26 during a cleaning operation exits the cleaner head 24 via a conduit 34 which extends upwardly from the cleaner head 24 and curves towards the front of the chassis 4 through approximately 90° of arc until it faces in the forwards direction. The conduit 34 terminates in a rectangular mouth 36 having a flexible bellows arrangement 38 shaped to engage with a complementary shaped duct 42 provided on the body 6.

The duct 42 is provided on a front portion 46 of the body 6, and opens into a forward facing generally semi-cylindrical recess 50 having a generally circular base platform 48. The recess 50 and the platform 48 provide a docking portion into which the separating apparatus 10 is mounted, in use, and from which it can be disengaged for emptying purposes.

It should be noted that in this embodiment the separating apparatus 10 consists of a cyclonic separator such as disclosed in WO2008/009886, the contents of which are incorporated herein by reference. The configuration of such separating apparatus is well known and will not be described any further here, save to say that the separating apparatus may be removably attached to the body 6 by a suitable mechanism such as a quick-release fastening means to allow the apparatus 10 to be emptied when it becomes full. The nature of the separating apparatus 10 is not central to the invention and the cyclonic separating apparatus may instead separate dirt from the airflow by other means that are known in the art for example a filter-membrane, a porous box filter or some other form of separating apparatus.

When the separating apparatus 10 is engaged in the docking portion 50, a dirty air inlet 52 of the separating apparatus 10 is received by the duct 42 and the other end of the duct 42 is connectable to the mouth 36 of the brush bar conduit 34, such that the duct 42 transfers the dirty air from the cleaner head 24 to the separating apparatus 10. The bellows 38 provide the mouth 36 of the duct 34 with a degree of resilience so that it can mate sealingly with the dirty air inlet 52 of the separating apparatus 10 despite some angular misalignment. Although described here as bellows, the duct 34 could also be provided with an alternative resilient seal, such as a flexible rubber cuff seal, to engage the dirty air inlet 52.

Dirty air is drawn through the separating apparatus 10 by an airflow generator which, in this embodiment, is an electrically powered motor and fan unit (not shown), that is located in a motor housing 60 located on the left hand side of the body 6. The motor housing 60 includes a curved inlet mouth 62 that opens at the cylindrical shaped wall of docking portion 50 thereby to match the cylindrical curvature of the separating apparatus 10. Although not seen in FIG. 4, the separating apparatus 10 includes a clean air outlet which registers with the inlet mouth 62 when the separating apparatus 10 is engaged in the docking portion 50. In use, the suction motor is operable to create low pressure in the region of the motor inlet mouth 62, thereby drawing dirty air along an airflow path from the suction opening 26 of the cleaner head 24, through the conduit 34 and duct 42 and through the separating apparatus 10 from dirty air inlet 52 to the clean air outlet. Clean air then passes through the motor housing 60 and is exhausted from the rear of the robot 2 through a filtered clean air outlet 61.

The cover 8 is shown separated from the body 6 in FIG. 4 and, since the chassis 4 and body 6 carry the majority of the functional components of the robot 2, the cover 8 provides an outer skin that serves largely as a protective shell and to carry a user control interface 70, described in further detail later.

The cover 8 comprises a generally cylindrical side wall 71 and a flat upper surface 72 which provides a substantially circular profile corresponding to the plan profile of the body 6, save for the part-circular cut-out 12 shaped to complement the shape of the docking portion 50, and the cylindrical separating apparatus 10. Furthermore, it can be seen that the flat upper surface 72 of the cover 8 is co-planar with the upper surface of the separating apparatus, which therefore sits flush with the cover when it is mounted on the main body.

Figure 2:
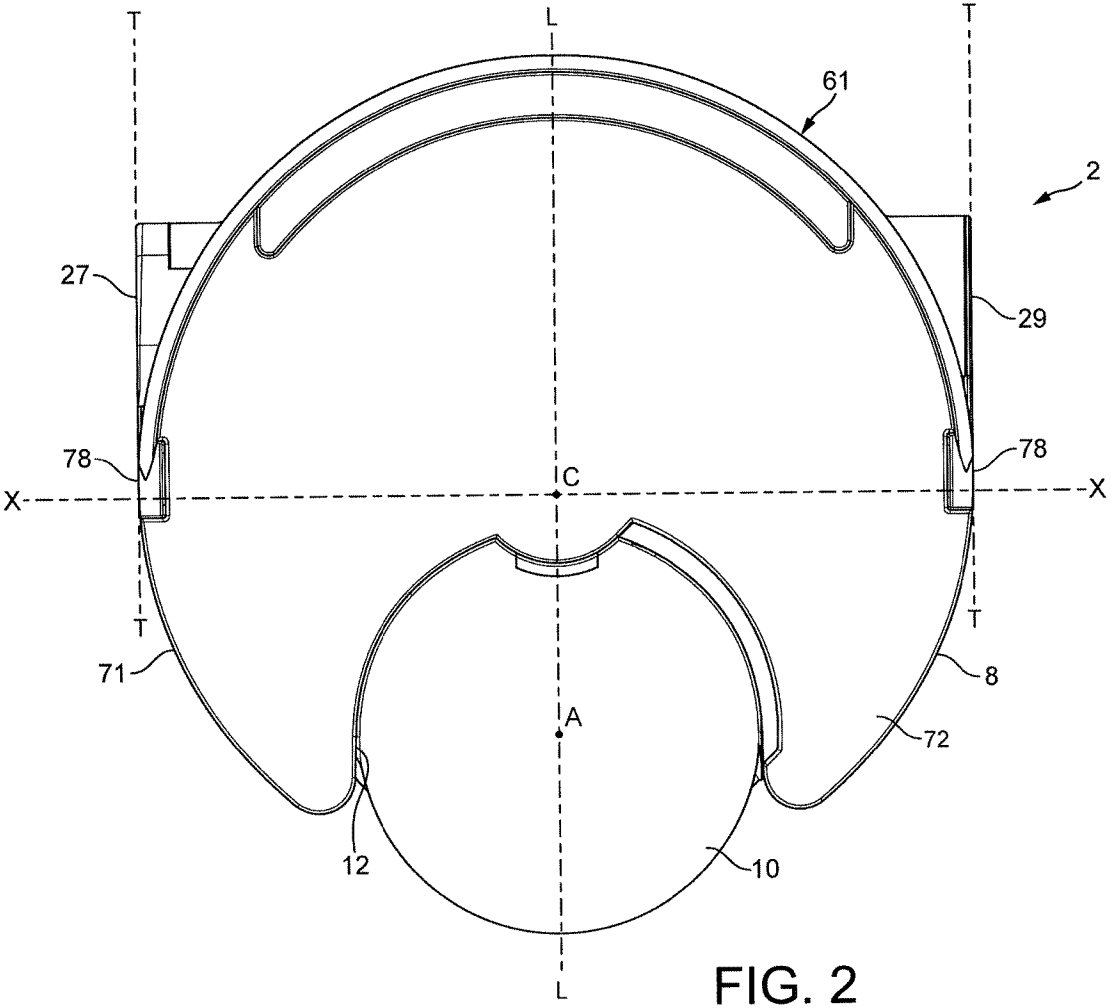
FIG. 2 is a plan view from above of the appliance in FIG. 1.

As can be seen clearly in FIG. 2, the part-circular cut-out 12 of the cover 8 and the semi-cylindrical recess 50 in the body 6 provides the docking portion a horseshoe shaped bay defining two projecting lobes or arms **73*a* which flank either side of the separating apparatus 10 and leave between approximately 5% and 40%, and preferably 20%, of the apparatus 10 protruding from the front of the docking portion 50. Therefore, a portion of the separating apparatus 10 remains exposed even when the cover 8 is in place on the main body of the robot 2, which enables a user ready access to the separating apparatus 10 for emptying purposes. Furthermore, the flanking arms 73*a* partially 'wrap' around, in effect enveloping the separating apparatus 10 which protect the apparatus from lateral impacts which could potentially dislodge the separating apparatus 10 from the main body of the robot 2. The flanking lobes are particularly suited to housing sensor modules, identified here at 75, which the robot may use to map its environment and/or to detect obstacles. In this case, the material of the projecting lobes 73** should be a suitable sensor-transparent material. The sensor modules may be any sensors suitable for robot navigation, such as laser range finders, ultrasonic transducers, position sensitive devices (PSDs) or optical sensors.

Opposite portions of the side wall 71 include an arched recess 74 (only one shown in FIG. 3) that fits over a respective end face 27, 29 of the cleaner head 24 when the cover 8 is connected to the body 6. As can be seen in FIG. 1, a clearance exists between the ends of the cleaner head 24 and the respective arches 74 order to allow for relative movement therebetween in the event of a collision with an object.

As has been mentioned, the separating apparatus 10 in the exemplary embodiment is a cylindrical bin that sits within the docking bay portion 50 of the robot and protrudes from the cover 8 so as to define a front of the robot 2. Note that the bin 10 has an upright orientation such that a longitudinal axis thereof (labeled as 'A' in the Figures) is normal to both the longitudinal and lateral axes L, X of the robot 2 and, therefore, substantially parallel to its cylindrical/vertical axis C. Having a portion of the separating apparatus 10 exposed at the front of the robot 2 in this way allows a user to gain easy access to the separating apparatus in order to remove it from the robot 2 when it needs to be emptied. Therefore, a user does not need to manipulate doors, hatches or panels in order to gain access to the separating apparatus 10. Furthermore, the separating apparatus may be transparent so that a user can see how full the separating apparatus is, thus avoiding the need for mechanical or electronic bin-full indicators. Furthermore, a separating apparatus, particularly a cyclonic separating apparatus is lighter than electronic components such as motors and batteries so the configuration of the separating apparatus on the front of the robot further assists the robot to climb up surfaces. In prior art machines, however, the heavier components tend to be positioned at the front whilst the dust containers are positioned at the rear or towards the centre of the machine.

A further advantage is that the separating apparatus 10 acts as a bumper for the robot 2 since being the forward most part of the robot means that it will be the first part of the robot to contact an obstacle during a collision. Preferably the bin is made from a plastics material of suitable mechanical properties to provide a degree of resilience in the event of the robot colliding with an obstacle. One example is transparent ABS (Acrylonitrile Butadiene Styrene) manufactured in a suitable thickness (for example between about 0.5 and 2 mm) to provide the bin 10 with a suitable degree of resilience. Therefore, the bin 10 provides a degree of protection for the main body of the robot 2 from hard and or sharp objects which may otherwise damage the cover 8. Similarly, the resilience of the bin provides a degree of protection for obstacles during collisions which may be vulnerable to damage.

The robot 2 further includes a carrying means in the form of a handle 76 to allow the robot 2 to be picked up and carried by a user. Details of the carrying handle 76 will now be described in further detail also with reference to FIGS. 5, 6, and 7.

The carrying handle 76 in this embodiment is semi-circular in form and extends between two diametrically opposite mounting bosses 78 located on either side of the cover 8 along the lateral axis X of the robot 2. The handle 76 is pivotable about the bosses 78 between a first, stowed position, in which the handle 76 fits into a complementary shaped recess or channel 80 on upper peripheral edge 81 of the cover 8, and a deployed position in which it extends upwardly so as to lie in a plane substantially perpendicular to the longitudinal axis L of the robot 2. An outer surface of the handle 76 is provided with a groove or channel 90 that serves as a gripping portion on which a user can find purchase in order to deploy the handle 76.

Figure 6:
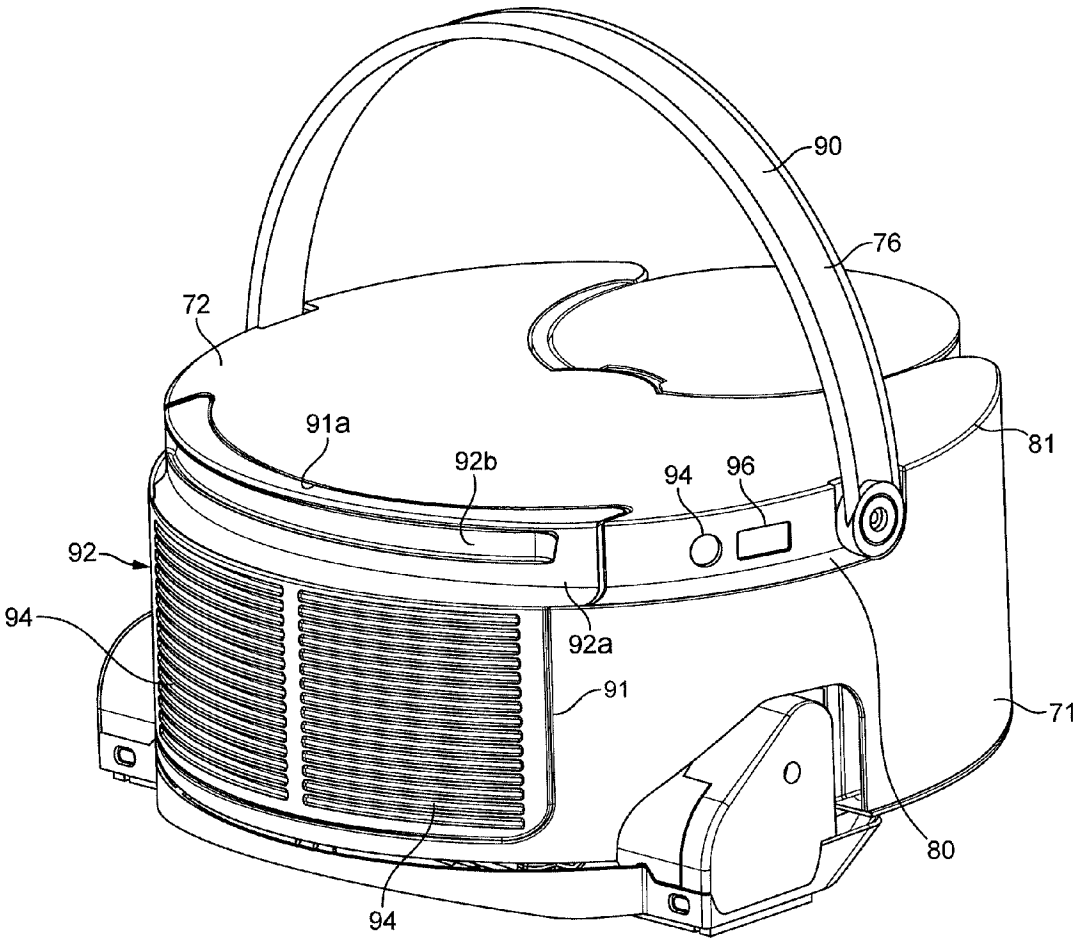
FIG. 6 is a rear perspective view of the appliance of the invention with its handle in a deployed position.
Figure 7:
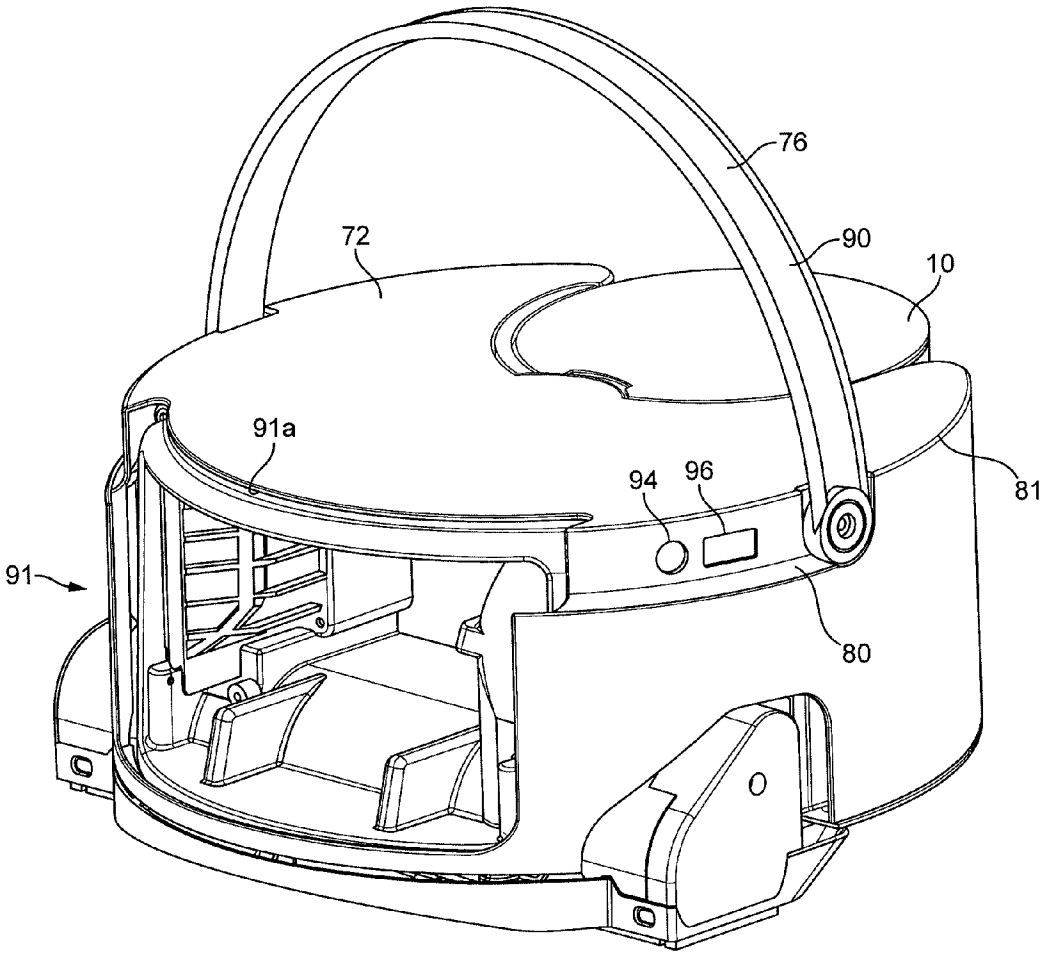
FIG. 7 is a rear perspective view of the appliance of the invention with the handle in the deployed position and with the removable panel removed.

The handle 76 is shown deployed in FIGS. 6 and 7. In the stowed position, the handle 76 maintains the 'clean' circular profile of the cover 8 and is unobtrusive to the use during normal operation of the robot 2. Note, for example, how the upper edge 76*a* of the handle 76 forms a continuance of the upper edge 81 of the side wall 71 of the cover 8. As well as the handle 76 being unobtrusive, by virtue of its diametrical mounting arrangement and the manner in which it stows into a portion of the cover 8, the handle 76 allows a user ready access to the handle 76 for carrying purposes and, when being carried, the robot 2 remains substantially in a horizontal orientation which makes the robot 2 easy to pick up, carry, and put down again onto a surface with one hand. Although not shown here, it should be appreciated that the handle 76 may also be spring-biased into its stowed position by an appropriate coil spring(s) housed within the pivot bosses 78.

In addition to the handle 76 being able to sit snugly and unobtrusively in a portion of the cover 8 when in a stowed position, the handle 76 is also operable to engage a further component of the robot 2 in order to prevent access to, or removal of, the component, as will now be described.

Figure 5:
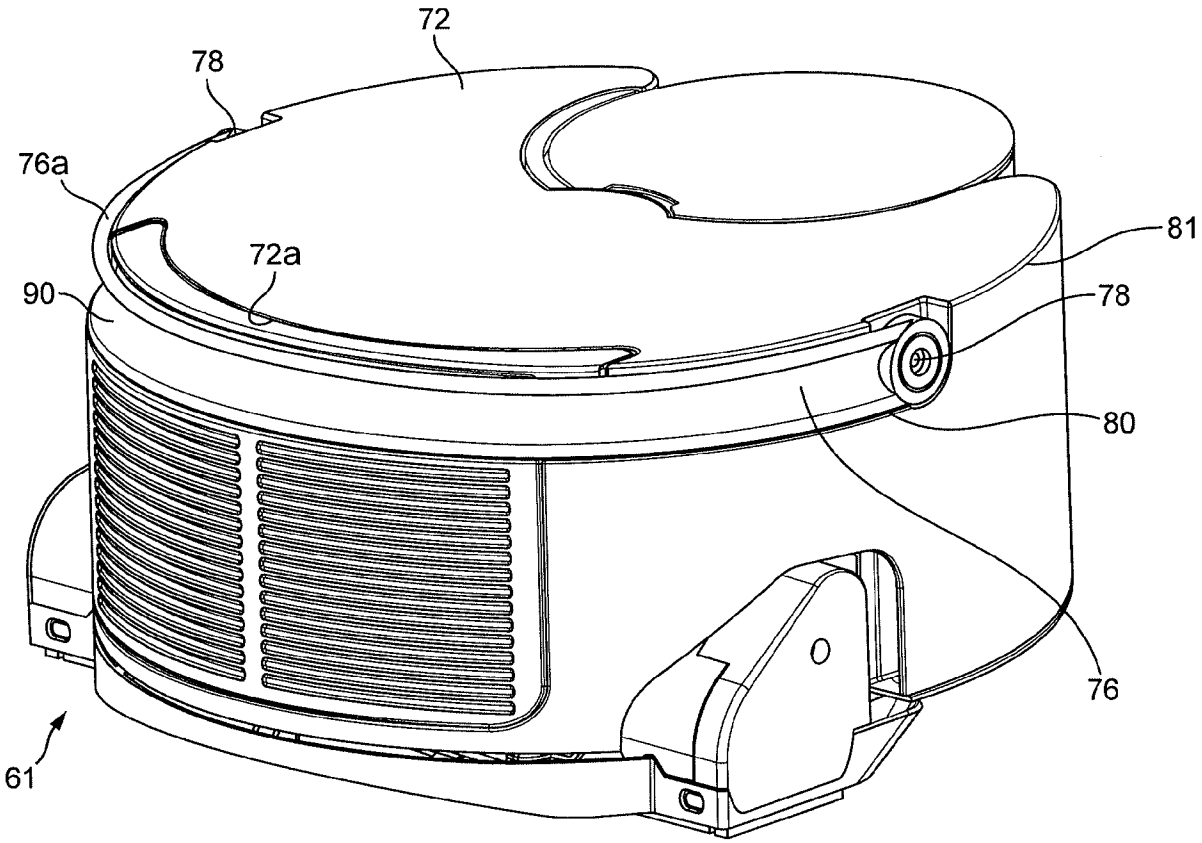
FIG. 5 is a rear perspective view of the appliance of the invention with its handle in a stowed position.

As shown particularly clearly in FIGS. 5, 6 and 7, a rear portion of the cover 8 includes an opening 91 within which is received a removable panel 92 that is provided with two groups of venting louvers or slits 94 and so provides an exhaust outlet for the suction generator. The panel 92 is generally flat and curved so as to confirm to the curvature of the side wall 71 of the cover 8. The panel 92 extends around the circumference of the cover 8 for approximately 90° of arc, although this is not essential to the inventive concept; the panel 92 could be smaller is desired or, alternatively, multiple panels could be provided.

So as to confirm fully to the shape of the cover 8, an upper portion 92*a* of the panel 92 is stepped or recessed to define a channel that emulates the handle recess 80 of the cover side wall 71. Therefore, when the handle 76 is in the stowed position, it engages with the recessed portion of the panel 92 so as to prevent it from being removed from the robot 2 accidentally. To make a positive engagement between the handle 96 and the panel 92, one or both of the handle 76 and panel 92 may include complementary formations so that the handle 76 is required to be snapped into place on the panel 92 when put into the stowed position. To this end, in the illustrated embodiment the recessed portion of the panel 92*a* includes an elongate groove or flute 92*b* into which a complementary shaped rib (not shown) on the handle is engageable. The handle 76 is therefore able to engage with the panel 92 by way of a removable snap-fit. Also, once the handle 76 has been deployed, the groove 92*b* provides a gripping feature for a user to enable easy removal of the panel from the robot 2.

The upper edge of the panel 92 defines a lipped portion 92*c* which is shaped to complement a respective part 91*a* of the opening 91 that extends up onto the upper surface 72 of the cover 8. When the panel 92 is in its fully 'home' position in the opening 91, the lipped portion 92*c* lies flush with the upper surface 72 of the cover 8 and so provides a ready-reference to a user that the panel 92 has been located correctly.

In the illustrated embodiment, the panel includes louvers 94 and so constitutes the exhaust port for the suction generator of the robot 2. To this end, therefore, although not shown in the Figures, the panel 92 may also incorporate a filter element (not shown) that is suitably secured to the inboard surface of the panel to provide an air tight seal so that air flow from the suction generator can pass only through the filter element and the panel venting louvers 94.

In addition to providing a retention function for the panel 92 so as to prevent or allow its removal, the handle 76 also provides a further function. As seen in FIGS. 6 and 7, the outward facing surface of the channel 80 defines first and second openings 94, 96 which may be electrical sockets. In the exemplary embodiment, the first socket 94 is circular and may be a socket for a power jack and the second jack is rectangular and may be a communications port (for example a USB port) for the control system of the robot 2. Due to their location in the channel 80, a user can access the sockets 94, 96 when the handle 76 is in the deployed position, but is prevented from accessing the sockets when the handle 76 is in the stowed position, as seen in FIG. 5, in which the handle 76 overlies at least a portion, but preferably the entirety, of the sockets 94, 96. Notably, therefore, the handle 76 performs multiple roles: firstly, it enhances the portability of the robot 2 by providing a readily accessible carrying handle and ensures that the robot 2 is carried at a relatively flat orientation; secondly it functions to retain a removable panel of the robot 2 securely when the robot is operating; and, thirdly it selectively allows or prevents access to electrical ports 64, 96 of the robot which guards against inadvertent damage during operation due to the build-up of dust and debris in the ports 94, 96.

Figure 8:
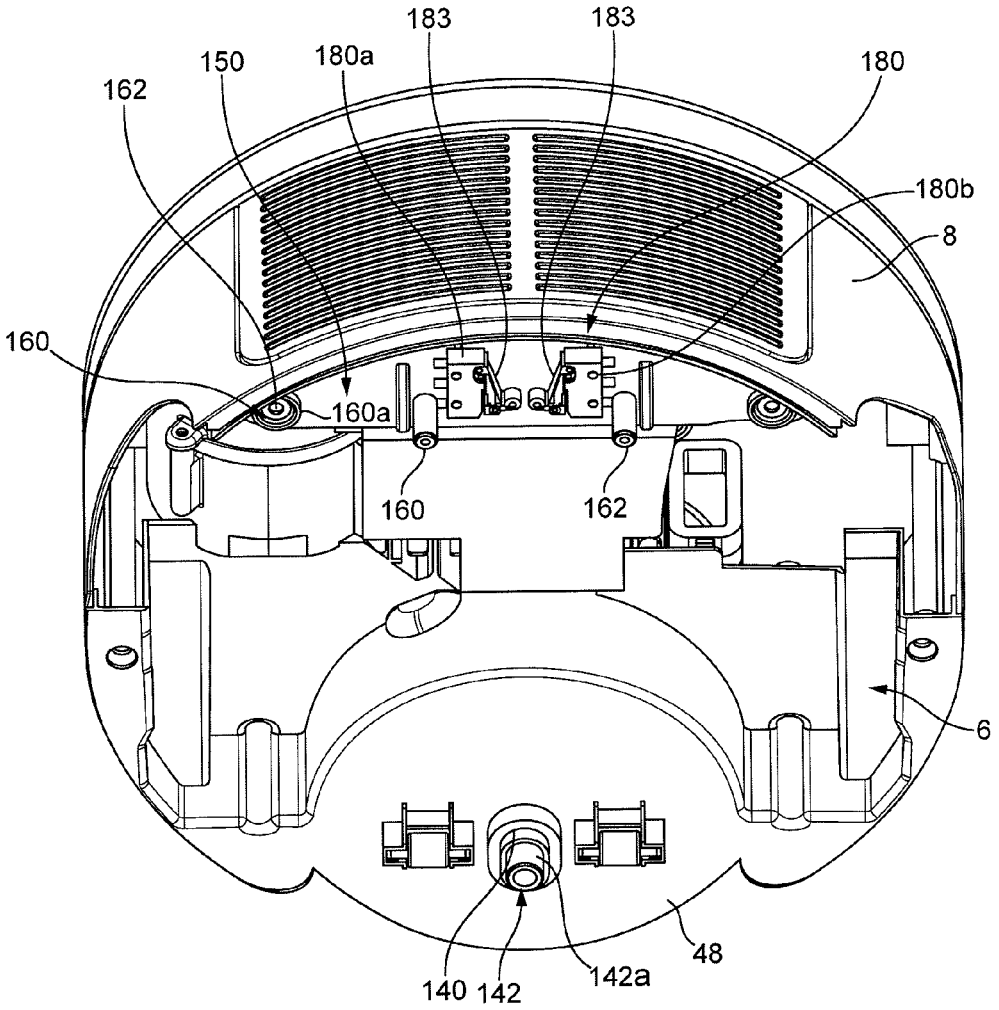
FIG. 8 is a front view of the chassis of the mobile robot.
Figure 9:
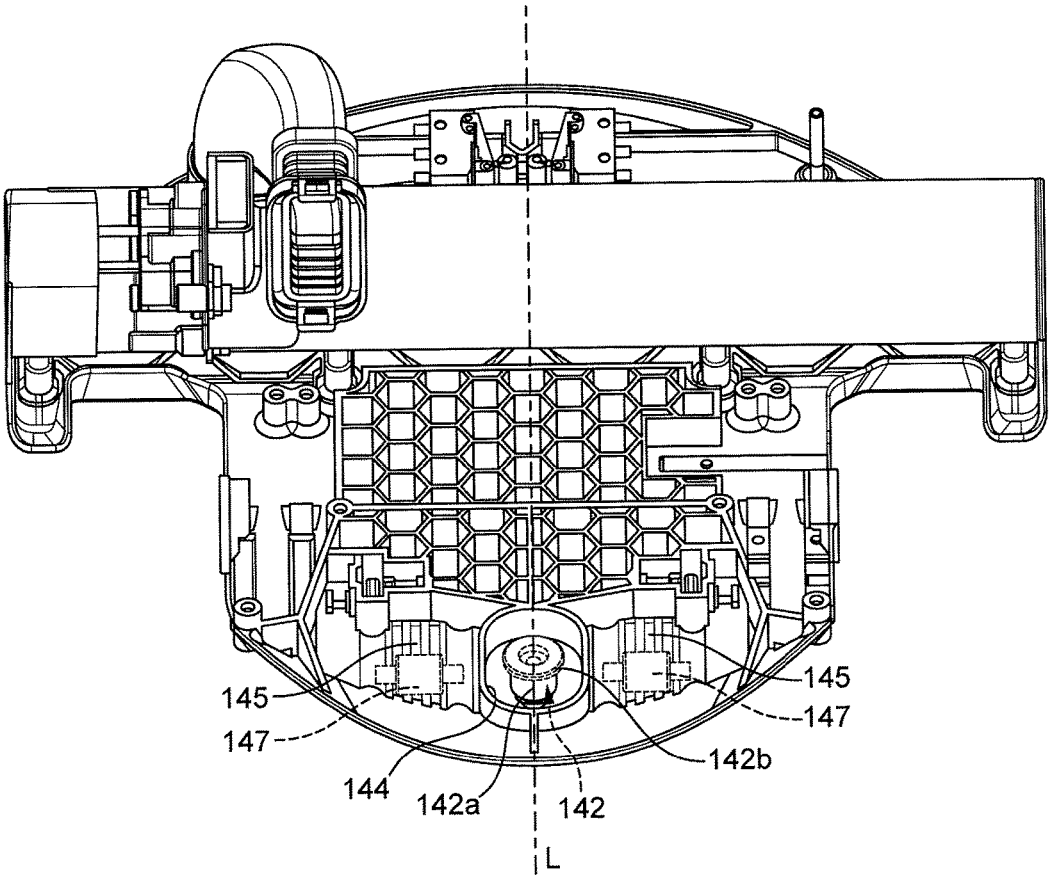
FIG. 9 is a view from underneath of the main body of the mobile robot.
Figure 10:
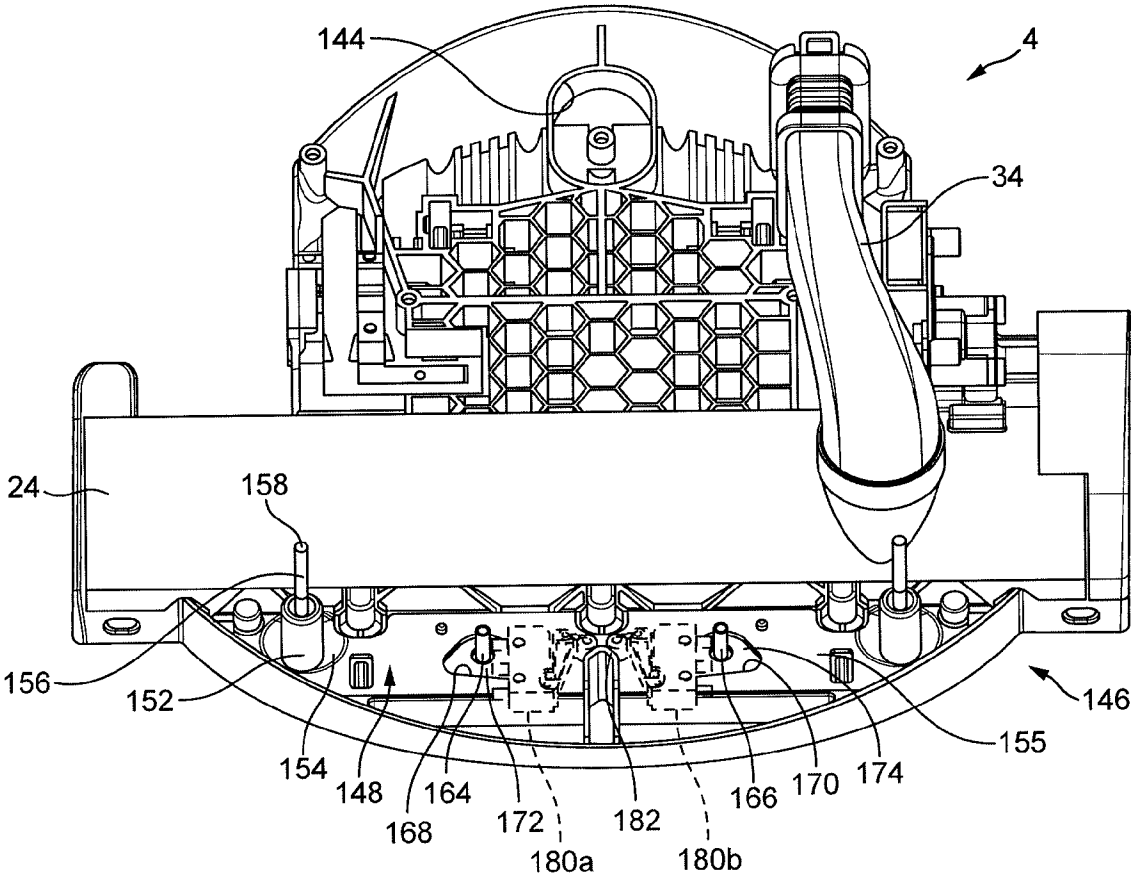
FIG. 10 is a rear view of the chassis of the mobile robot.

Referring now to FIGS. 8, 9 and 10, these illustrate how the body 6 is attached to the chassis 4 to enable relative sliding movement between one another and how this relative moment is used by the robot 2 to gather information about collisions with objects in its path.

To enable relative sliding movement between the chassis 4 and the body 6, front and rear engagement means fix the chassis 4 and the body 6 together so that they cannot be separated in the vertical direction, that is to say in a direction normal to the longitudinal axis L of the robot 2, that is to say along its cylindrical axis, but are permitted to slide with respect to one another by a small amount.

Turning firstly to the front portion of the body 6, as best illustrated in FIG. 8, a front engagement means includes a slot-like opening 140 which is shaped to be generally oval like a racetrack/stadium or a para-truncated circle that is defined in the front portion of the body 6, specifically in a central position in the platform 48. A slidable pivoting member in the form of a gudgeon pin 142 is received through the opening and includes a sleeve section 142*a* that extends a short way below the opening 140 and an upper flange 142*b*.

The engagement means also includes a complementary structure on the forward portion of the chassis 4 in the form of a walled-recess 144, which is also racetrack shaped to correspond to the shape of the opening 140 in the platform 48. The body 6 is mountable on the chassis 4 so that the opening 140 on the platform 140 body 6 overlies the recess 144 in the chassis 4. The gudgeon pin 142 is then secured to the floor of the recess 144 by a suitable mechanical fastener such as a screw; the gudgeon pin 142 is shown ghosted in its position in the recess 144 in FIG. 8. The body 6 is therefore joined to the chassis 4 against vertical separation. However, since the gudgeon pin 142 is fixed immovably to the chassis 4 whilst being held slidably in the opening 140, the body 6 can slide relative to the gudgeon pin 142 and/or can pivot angularly about it due to its rounded shape.

The forward portion of the chassis 4 also includes two channels 145, one located on either side of the recess 144, which serve as a supporting surface for respective rollers 147 provided on the underside of the body 6 and, more specifically, on the platform 48 either side of the opening 140. The rollers 147 provide support for the body 6 on the chassis 4 and promote smooth sliding movement between the two parts and are shown in ghosted form in FIG. 9.

The rear engagement means constrains movement of a rear portion 150 of the body 6 relative to the chassis 4. From a comparison between FIG. 8 and FIG. 10, it can be seen that a rear portion 146 of the chassis 4 behind the cleaner head 24 includes a bump detection means 148 which also serves as a secure mounting by which means the rear portion 150 of the body 6 is connected to the chassis 4.

Each side of the bump detection means includes a body support means; both body support means are identical and so only one will be described in detail for brevity. The body support means comprises a sleeve-like tubular supporting member 152 that sits in a dished recess 154 defined in the chassis 154. In this embodiment, the dished recess 154 is provided in a removable chassis portion in the form of a plate member 155 that is fixed across the rear portion 146 of the chassis 4. However, the recesses 154 could equally be an integral part of the chassis 4.

A spring 156 is connected to the chassis 154 at its lower end and extends through the sleeve member 152, wherein the end of the spring terminates in an eyelet 158. The sleeve 152 and the spring 156 engage with a complementary socket 160 on the underside of the body 6, which socket 160 includes a raised wall 160*a* with which the upper end of the sleeve 152 locates when the body 6 is mounted onto the chassis 4. When mounted in this way, the spring 156 extends into a central opening 162 in the socket 160 and the eyelet 158 is secured to a securing pin within the body 6. Note that the securing pin is not shown in the figures, but may be any pin or suitable securing point to which the spring can attach.

Since the supporting sleeve members 152 are movably mounted between the chassis 4 and the body 6, the sleeve members 152 can tilt in any direction which enables the body 6 to 'rock' linearly along the longitudinal axis 'L' of the robot, but also for the rear portion of the body 6 to swing angularly, pivoting about the gudgeon pin 142 by approximately 10 degrees as constrained by the rear engagement means as will now be explained further. In this embodiment, the springs 156 provide a self-centering force to the supporting sleeve members 152 which urge the sleeves members 152 into an upright position, this action also providing a resetting force for the bump detection system. In an alternative embodiment (not shown), the supporting sleeve members 152 could be solid, and a force to 'reset' the position of the body relative to the chassis could be provided by an alternative biasing mechanism.

Although the sleeve members 152 allow the body 6 to 'ride' on the chassis 4 with a certain amount of lateral movement, they do not securely connect the rear portion 150 of the body 6 to the chassis 4 against vertical separation. For this purpose, the bump detection means 148 includes first and second guiding members in the form of posts or rods 160, 162 provided on the body 6 which engage with respective pins 164, 166 provided on the chassis 4. As can be seen in FIG. 10, the pins 164, 166 extend through respective windows 168, 170 defined in the plate member 155 and are retained there by a respective washer 172, 174. In order to mount the rear portion 150 of the body 6 onto the rear portion 146 of the chassis 4, the guiding members 160, 162 are push fit onto the pins 164, 166 until they contact their respective washer 172, 174. The movement of the rear portion 150 of the body 6 is therefore constrained to conform to the shape of the windows 168, 170 such that the windows serves as a guiding track. In this embodiment, the windows 168, 170 are generally triangular in shape and so this will permit the body 6 to slide linearly with respect to the gudgeon pin 142 but also to swing angularly about it within the travel limits set by the windows 168, 170. However, it should be noted that the permitted movement of the body 6 can be altered by appropriate re-shaping of the windows 168, 170.

The bump detection means 148 also includes a switch means 180 to detect movement of the body 6 relative to the chassis 4. The switch means 180 includes first and second miniature snap-action switches 180*a*, 180*b* (also commonly known as 'micro switches') provided on the underside of the rear portion 150 of the body 6 that, when the body 6 is mounted to the chassis 4, are located either side of an actuator 182 provided in a central part of the rear portion 146 of the chassis 4. In this embodiment, the actuator 182 takes the form of a wedge-shape having angled leading edges for activating the switches 180*a*, 180*b*. Although not shown in the Figures, the switches 180*a*, 180*b* are interfaced with the control means of the robot. The location of the switches 180*a*, 180*b* relative to the wedge-shaped actuator 182 is shown in FIG. 10; note that the switches 180*a*, 180*b* are shown in dotted lines. As can be seen, the switches 180*a*, 180*b* are positioned such that their activating arms 183 are positioned directly adjacent and either side of the angled forward edges of the wedge-shaped actuator 182.

The switches 180*a*, 180*b* are activated in circumstances where the robot 2 collides with an obstacle when the robot is navigating around a room on cleaning task. Such a bump detection facility is desirable for an autonomous vacuum cleaner since sensing and mapping systems of such robots can be fallible and sometimes an obstacle will not be detected in time. Other robotic vacuum cleaners operate on a 'random bounce' methodology in which a means to detect a collision is essential. Therefore, a bump detection facility is needed to detect collisions so that a robot can take evasive action. For example the control means may determine simply to reverse the robot and then to resume forward movement in a different direction or, alternatively to stop forward movement, to turn 90° or 180° and then to resume forward movement once again.

Activation of the switches 180*a*, 180*b* will now be explained with reference to FIGS. 11*a*, 11*b*, 11*c* and 11*d*, which show a schematic representation of the chassis 4, body, 6 and bump detection means in different bump situations. In the following figures, the parts common with the previous figures are referred to with the same reference numerals.

Figure 11A:
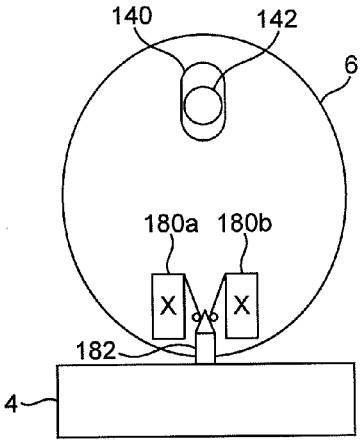
FIGS. 11*a*, 11*b*, 11*c* and 11*d* are schematic views of the robot in various 'bump' conditions.

FIG. 11*a* shows the relative positions of the body 6, the chassis 4, the gudgeon pin 142, the body pivot opening 140, the switches 180*a*, 180*b* and the wedge-shaped actuator 182 in a non-collision position. As can be seen, neither switch 180*a*, 180*b* has been activated as indicated by the reference 'X'.

Figure 11B:
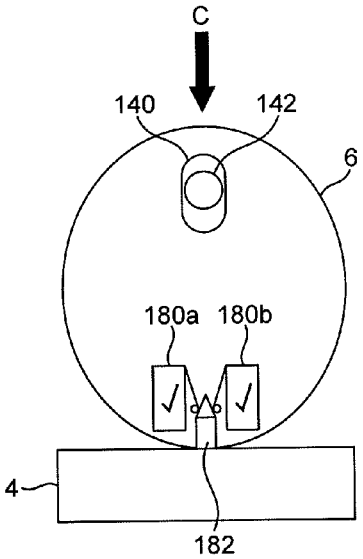

FIG. 11*b* shows the robot 2 in a collision with an obstacle in the 'dead ahead' position, as indicated by the arrow C. The body 6 is caused to move backward linearly, that is to say along its longitudinal axis L and, accordingly, the two switches 180*a*, 180*b* are moved backwards with respect to the wedge-shaped actuator 182 thereby triggering the switches 180*a*, 180*b* substantially at the same time as indicated by the 'tick' or 'check' marks.

Figure 11C:
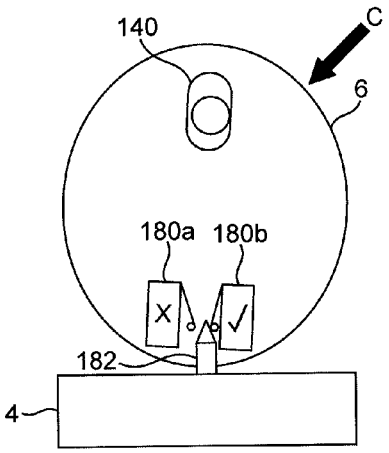

Alternatively, if the robot 2 collides with an obstacle on its right hand side, as indicated by the arrow C in FIG. 11*c*, the body 6 will be caused to swing about the gudgeon pin 142 to the left and, in these circumstances, the switches 180*a*, 180*b* will move to the left with respect to the actuator 182 with the result that the right hand switch 180*b* is activated before activation of the left hand switch 180*a* as indicated by the check mark for switch 180*b*.

Figure 11D:
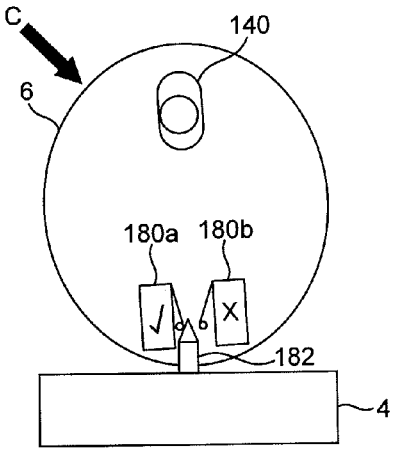

Conversely, if the robot 2 collides with an obstacle on its left hand side, as indicated by the arrow C in FIG. 11*d*, the body 6 will be caused to swing to the right, in which case the switches 180*a*, 180*b* will move to the right with respect to the actuator 182, which therefore triggers the left hand switch 180*a* before the right hand switch 180*b* as indicated by the check mark for switch 180*a*.

Although in the oblique angle collisions shown in FIGS. 11*c* and 11*d* only one of the switches 180*a*, 180*b* is shown as activated, it should be appreciated that such a collision may also activate the other one of the switches, albeit at a later time than the first activated switch.

Since the switches 180*a*, 180*b* are interfaced to the control means of the robot, the control means can discern the direction of impact by monitoring the triggering of the switches 180*a*, 180*b*, and the relative timing between triggering events of the switches.

Since the robot 2 is able to detect collisions by sensing relative linear and angular movement between the body 6 and the chassis 4, the invention avoids the need to mount a bump shell onto the front of the robot as is common with known robotic vacuum cleaners. Bump shells can be fragile and bulky so the invention increases the robustness of the robot and also makes possible a reduction in size and complexity.

The sensing means has been described as comprising snap-action switches disposed either side of a wedge-shaped actuator and that such an arrangement conveniently enables the switches to be activated when the body moves linearly (both switches activated simultaneously) or angularly (one switch activated before the other). However, the skilled person will appreciate that other switch mechanisms are possible, for example contactless switches such as a light-gate switch, or a magnetic/Hall effect switch.

Figure 12:
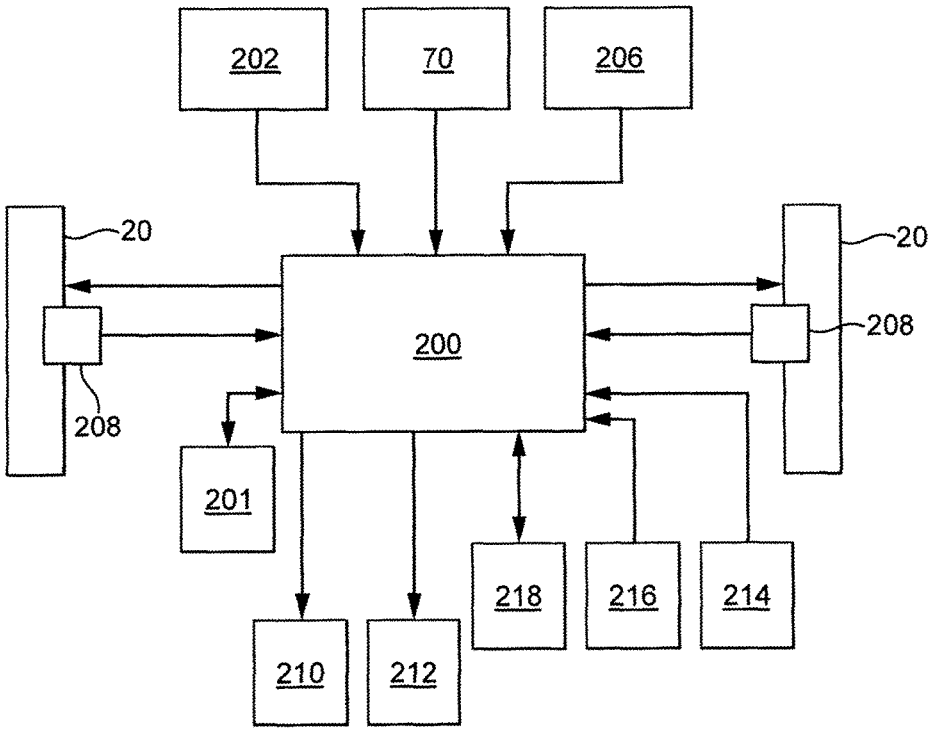
FIG. 12 is a schematic systems view of the appliance.

In operation, the robot 2 is capable of propelling itself about its environment autonomously, powered by a rechargeable battery pack (not shown). To achieve this, the robot 2 carries an appropriate control means which is shown schematically in FIG. 12. The control means takes the form of a controller 200 including appropriate control circuitry and processing functionality to process signals received from its various sensors and to drive the robot 2 in a suitable manner. The controller 200 is interfaced into a sensor suite 202 of the robot 2 by which means the robot gathers information about its immediate environment in order to map its environment and plan an optimum route for cleaning. Although not shown in the figures, the sensor suite 202 may be located in the upright lobes 73 on the front of the robot which provides an unobstructed view of the path ahead. The sensor suite may comprise infrared and ultrasonic transmitters and receivers providing the controller 200s with information representative of the distance of the robot 2 from various features in an environment and the size and shape of those features. Additionally the controller 200 is interfaced to the suction fan motor, labeled 210 in FIG. 12, and the brush bar motor 212 in order to drive and control these components appropriately. The controller 200 is therefore operable to control the traction units 20 in order to navigate the robot 2 around the room which is to be cleaned. It should be noted that the particular method of operating and navigating the robotic vacuum cleaner is not material to the invention and that several such control methods are known in the art. For example, one particular operating method is described in more detail in WO00/38025 in which navigation system a light detection apparatus is used. This permits the cleaner to locate itself in a room by identifying when the light levels detected by the light detector apparatus is the same or substantially the same as the light levels previously detected by the light detector apparatus.

A memory module 201 is provided for the controller to carry outs its processing functionality and it should be appreciated that the memory module 201 could alternatively be integrated into the controller 200 instead of being a separate component as shown here.

The controller 200 also has suitable inputs from the user interface 70, suitable rotational sensing means 208 such as rotary encoders provided on the traction units 20, and a bump detection means 206 which will be described in more detail later in the specification. Power and control inputs are provided to the traction units 20 from the controller 200 and also to the suction motor 210 and the brush bar motor 212.

Finally, a power input is provided to the controller 200 from the battery pack 214 and a charger interface 216 is provided by which means the controller 200 can carry out charging of the battery pack 214 when the battery supply voltage has dropped below a suitable threshold. The charger interface 216 may be the electrical input socket 94 described above. Additionally, an electronic communication input/output line 218 is provided in order for the controller to provide data to an external computer, for example for diagnostics purposes, and to enable the controller 200 to be reprogrammed as necessary. The input/output line 218 may be the data port 96 described above.

Many variations are possible without departing from the inventive concept. For example, although the robot 2 has been described as being generally circular in plan profile, it will be appreciated that it could also take the form of other polygonal cylinders other than circular, the main consideration being maneuverability in confined spaces. For example, the main body could take the general form of a pentagonal, or octagonal cylinder for example, or even a square section cylinder. The same applies to the separating apparatus. Although it has been described as being a cylindrical bin with a circular cross section in this specific embodiment, it may also take other forms such as more of a box-like structure with a square or rectangular cross section, or another form of cylinder with a polygonal base.

Also, although the robot 2 has been described as having a single panel 92 with which the handle 76 engages when in a stowed position, there may alternatively be provided a plurality of panels for different functions.

In the embodiment above, the body 6 has been described as being able to move linearly as well as angularly about the chassis. However, it should be appreciated that this is such that collisions can be detected from a wide range of angles and that the invention resides also in a bump detection system in which the body moves linearly or angularly to the chassis instead of a combination of such movement.

The invention claimed is:

1. An autonomous vacuum cleaner comprising a main body defining a first cylindrical axis and housing a dirty air inlet, a clean air outlet, an airflow path between the dirty air inlet and the clean air outlet, a forward-facing docking portion, and a separating apparatus arranged in the air flow path between the dirty air inlet and the clean air outlet, the separating apparatus defining a second cylindrical axis, wherein the separating apparatus is removably mounted into the docking portion, and is oriented so that the second cylindrical axis is substantially parallel with the first cylindrical axis of the main body and wherein a portion of the separating apparatus protrudes from a front of the docking portion.

2. The vacuum cleaner of claim 1, wherein the main body defines a substantially flat upper surface and wherein the separating apparatus defines a substantially flat upper surface which is co-planar with the upper surface of the main body.

3. The vacuum cleaner of claim 1, wherein the docking portion comprises a recess being shaped to complement the outer profile of the separating apparatus.

4. The vacuum cleaner of claim 3, wherein the docking portion includes a platform portion to support a lower end of the separating apparatus.

5. The vacuum cleaner of claim 3, wherein the main body defines first and second arm portions that flank opposite sides of the separating apparatus.

6. The vacuum cleaner of claim 5 wherein the first and second arm portion are sensor housings.

7. The vacuum cleaner of claim 3, wherein the main body includes an airflow generator for generating an airflow along the airflow path from the dirty air inlet to the clean air outlet.

8. The vacuum cleaner of claim 3, wherein the main body includes a chassis, the chassis including at least one traction unit for supporting the main body on a surface, and a cleaner head that defines the dirty air inlet.

9. The vacuum cleaner of claim 1, wherein the main body is substantially cylindrical.

10. The vacuum cleaner of claim 1, wherein the separating apparatus is substantially cylindrical.

11. An autonomous vacuum cleaner comprising a cylindrical main body having a first cylindrical axis and housing a dirty air inlet, a clean air outlet, an airflow path between the dirty air inlet and the clean air outlet, a forward-facing docking portion, and a separating apparatus arranged in the air flow path between the dirty air inlet and the clean air outlet, the separating apparatus comprising a cylindrical container having a second cylindrical axis, wherein the separating apparatus is removably mounted into the docking portion, and is oriented so that its cylindrical axis is substantially parallel with the cylindrical axis of the main body and wherein a portion of the separating apparatus protrudes from a front of the docking portion.

12. The vacuum cleaner of claim 11, wherein the main body defines a substantially flat upper surface and wherein the separating apparatus defines a substantially flat upper surface which is co-planar with the upper surface of the main body.

13. The vacuum cleaner of claim 11, wherein the docking portion comprises a recess being shaped to complement the outer profile of the separating apparatus.

14. The vacuum cleaner of claim 13, wherein the docking portion includes a platform portion to support a lower end of the separating apparatus.

15. The vacuum cleaner of claim 13, wherein the defines first and second arm portions that flank opposite sides of the separating apparatus.

16. The vacuum cleaner of claim 15 wherein the first and second arm portion are sensor housings.

* * * * *